US007040135B2

(12) United States Patent
Stuhlmacher, II

(10) Patent No.: US 7,040,135 B2
(45) Date of Patent: May 9, 2006

(54) LEVER DEVICE FOR ALIGNING A VEHICLE DOOR

(76) Inventor: Glen Stuhlmacher, II, 45 Cuenca Ct., San Ramon, CA (US) 94583

( * ) Notice: Subject to any disclaimer, the term of this patent is extended or adjusted under 35 U.S.C. 154(b) by 223 days.

(21) Appl. No.: 10/802,972

(22) Filed: Mar. 18, 2004

(65) Prior Publication Data

US 2005/0225096 A1 Oct. 13, 2005

(51) Int. Cl.
*B21D 1/12* (2006.01)

(52) U.S. Cl. ..... 72/458; 72/705

(58) Field of Classification Search ..... 72/458, 72/705

See application file for complete search history.

(56) References Cited

U.S. PATENT DOCUMENTS 4,399,683 A 8/1983 Hunter
5,331,837 A 7/1994 Stuhlmacher, II
D368,839 S 4/1996 Hunter
5,562,001 A * 10/1996 Bell ..... 72/458

OTHER PUBLICATIONS

Steck Items 17000-21840.

* cited by examiner

*Primary Examiner*—Lowell A. Larson
(74) *Attorney, Agent, or Firm*—Harold James; Epstein Drangel Bazerman & James, LLP

(57) ABSTRACT

An apparatus for aligning an associated vehicle door with the cooperating portions of a vehicle body comprising a lever having a part adapted to engage in a latch at the door, which part extends from the lever to an adjustable degree, the lever carrying the protector plate relatively fixedly secured thereto which is adapted to be moved against the door without rotation when said part is moved into engagement with said door, adjustment of the position of the latch-engaging part relative to the rest of the lever being accomplished through manipulation of an element located at a conveniently accessible portion relatively remote from the door being aligned.

11 Claims, 4 Drawing Sheets

LEVER DEVICE FOR ALIGNING A VEHICLE DOOR

BACKGROUND OF THE INVENTION

The present invention relates to a tool used for the alignment of a door in a vehicle.

In my prior U.S. Pat. No. 5,331,837 of Jul. 26, 1994, entitled "VEHICLE DOOR ALIGNMENT DEVICE", I have disclosed in some detail the problems involved in the alignment of a door in a motor vehicle by applying force to the door until an area at or near the door hinge is bent and the door is aligned. I have shown, particularly in FIG. 3 of that patent, a lever-type device having a part engaging the door latch and which is provided with a plate rotatably adjustable thereon so as to be moveable into engagement with the end surface of the door, thereby to clamp the lever to the door. That plate is coated with or formed by a material such as rubber or plastic that will not scratch the paint of the door or otherwise damage the door edge surface or anything which may be applied to that surface, such as vehicle identifications numbers or computerized bar codes, which are today normally glued or otherwise applied to the door edge surface. The space available to gain access to that plate and rotate it into position is quite often exceedingly restricted, making it difficult properly to secure the lever to the door or to retract the plate once alignment is completed in order to conveniently disengage the lever from the door. Moreover, the fact that that plate must be rotated into engagement with the door surface is in itself a source of trouble, because of the attendant rubbing and scraping on the door surface, as well as causing excessive wear on the protective rubber or plastic surface of the plate itself.

OBJECTS OF THE INVENTION

It is therefore a prime object of the present invention to devise a lever-type vehicle door alignment device having the advantages of the devices disclosed in my U.S. Pat. No. 5,331,837 but in which the adjustment of the parts to engage the door is accomplished in a more conveniently accessible manner than has heretofore been possible.

It is another prime object of the present invention to provide a lever-type device in which a door-engaging protector plate engages the door firmly but without rotation relative to the door, thus minimizing damage to and wear of the protector plate and the engaged door surface.

It is another object of the present invention to provide such a door aligning device which requires less space to operate than has been the case with prior devices.

It is another object of the present invention to provide such a device in which all of the parts are sturdy, may be readily fabricated without requiring costly precision, and which function effectively when assembled to perform the desired functions.

It is a further object of the present invention to devise such a device which may be readily attached to align the doors of differently designed vehicles.

It is yet another object of the present invention to provide a door alignment tool having the advantages of the tools disclosed in my aforementioned U.S. Pat. No. 5,331,837. but which may be more readily and reliably attached or detached from the vehicle door without damage to or excessive wear of the door surface or the door-engaging tool surface.

SUMMARY OF THE INVENTION

To those ends, the door-latch-engaging means mounted on the lever comprises a part adjustably mounted on the lever to extend out therefrom to a desired degree and having an end adapted to be engaged in the latch of the vehicle door. Adjustment of the part is accomplished by a readily manipulatable element such as a wheel which is accessible from the exterior of the lever at a location relatively remote from the door and which, when manipulated, causes the latch-engaged end of the part to move toward and away from the lever, thus causing the lever to move toward and away from the door edge surface between door-clamping and door-unclamping positions. In addition, the lever is also provided, adjacent to and preferably surrounding that moveable part, with a protector plate attached to the face to be brought into engagement with the edge of the door when the door-engaged part has been adjustably moved into the lever, thus bringing that plate into non-rotatable engagement with the door edge. Preferably the manually accessible adjusting element is in the form of a wheel in threaded engagement with the part, so that rotation of the wheel causes the desired movement of the part.

DESCRIPTION OF THE DRAWINGS

To the accomplishment of the above, and to such other objects as may hereinafter appear, the present invention relates to the construction of a lever device for aligning a vehicle door as defined in the appended claims and as herein disclosed in the accompanying drawings, in which:

DETAILED DESCRIPTION

Figure 1:
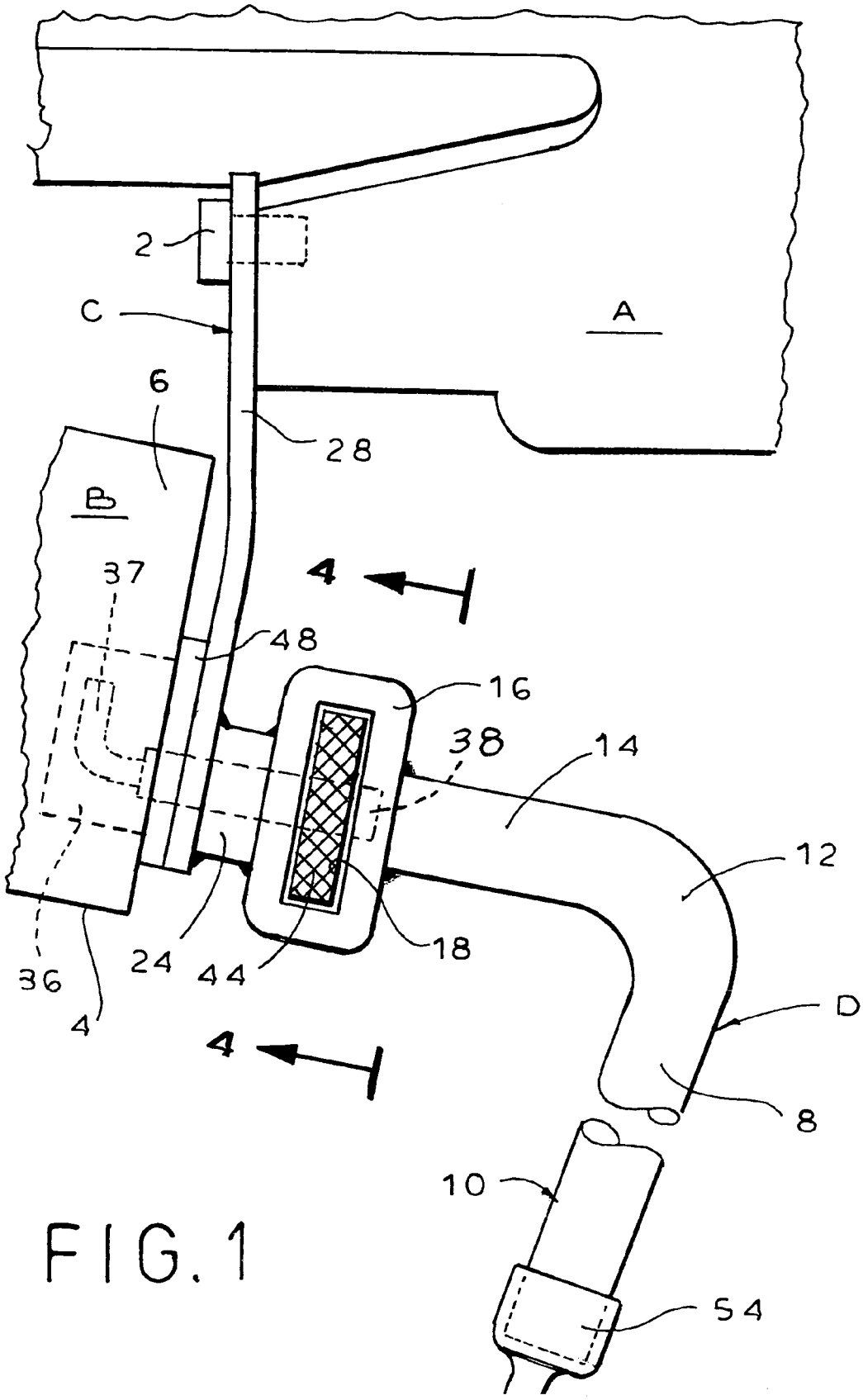
FIG. 1 is a top plan fragmentary view of the side of a vehicle with the lever device of the present invention positioned thereon ready for door alignment.

FIG. 1 discloses the front left-hand portion of an idealized motor vehicle having a body A on which a door B is mounted in conventional fashion to cooperate with a door jamb generally designated C. Automobile repairmen are often called upon to reposition the door B relative to the door body A and its jamb C in order to cause the parts to be in proper alignment. To that end, the alignment device generally designated D is attached to engage with a lock pin 2 on the door jamb C and a door latch generally designated 4 on the end edge 6 of the door B and then to change the relative positions of the pin 2 and the latch 4, thereby spatially adjusting the door B relative to the door body A and in particular the door jamb C.

The lever D in the embodiment here specifically disclosed is primarily formed of an elongated rigid member 8, here shown in the form of a tubular shaft, having an end 10 adapted to be manually grasped and extending from the end 10 for an appreciable distance to give the lever a good mechanical advantage and then, at 12, being curved into a section 14. The end of section 14 is welded to a housing 16 having an internal open space 18 exposed at its top and bottom and a pair of registering passages 20 and 22 opening into space 18. Welded to the edge of the housing 16 opposite the section 14 is a ring 24 having a central opening 26 registering with the housing opening 22, and welded to the exposed end of the ring 24 is an arm 28 extending laterally from the ring 24 an appreciable distance and terminating, in the embodiment here specifically disclosed, in an end notch 30 adapted to be received around the lock pin 2 on the door jamb. The arm 28, where it is welded to the ring 24, has an opening 32 which registers with the opening 26 in the ring 24.

Figure 5:
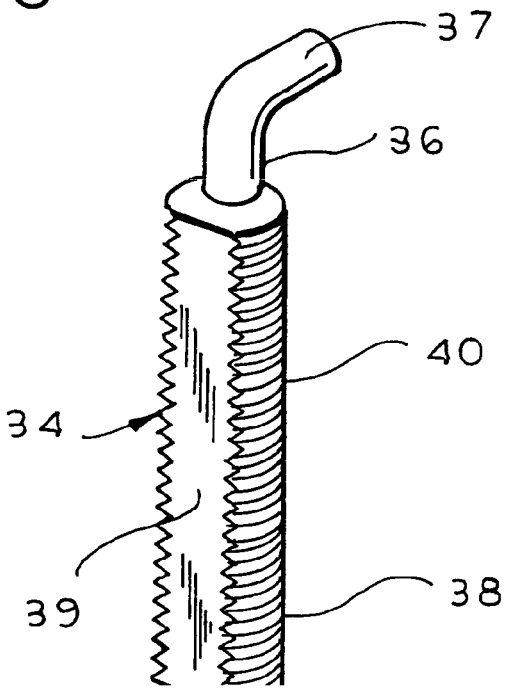
FIG. 5 is a perspective view of one embodiment of the part adapted to engage a door latch.

The tool is further provided with a part generally designated 34 which is adapted to engage the door latch 4. In the form here specifically disclosed the part comprises a rod 36 with a laterally bent end 37, the rod 36 being fixed to and extending from a shaft 38 externally threaded at 40 along its length but only partly around its periphery. The shaft 38 is adapted to slide axially through the openings 32, 26, 22 and 20 and, if necessary, into the open end of the tube 14, passing through the interior open space 18 of the housing 16. The externally threaded portion 40 of the shaft 38 does not threadedly engage the surfaces of any of those passages. However, the central open space 18 of the housing 16 contains a rotatable wheel 44 having an internally threaded passage 46 which threadedly engages with the external threads 40 on the shaft 38. The outer surface of the wheel 44, exposed at the top of the tool for manual access, may be knurled for ready rotation. The cross-section of the shaft 38 is preferably non-circular (see the flat side 39 best seen in FIG. 5) and at least one of the passages 20, 22, 26 or 30 through which it passes is of similar non-circular cross-section, so that the shaft 38 will not rotate with respect to the remainder of the structure. Hence, when the wheel 44, which preferably projects outwardly beyond the top and bottom of the housing 16, is rotated in one direction or another, the shaft 38 will be moved axially into and out from the tool, causing the portion 37 of the part 34 to move toward and away from the lever.

Mounted on the outwardly facing surface of the arm 28, adjacent to the part 34, is a protective plate 48 fixed to the arm 28 as by rivets 50. This protective plate 48 may be formed of or coated with rubber or plastic and to some extent corresponds to the plates 90 or 150 of my prior U.S. Pat. No. 5,331,837 but the plate 48 of the present invention, in contradistinction to the protective plates of my prior patent, is non-rotatable, being instead fixed to the lever.

Figure 2:
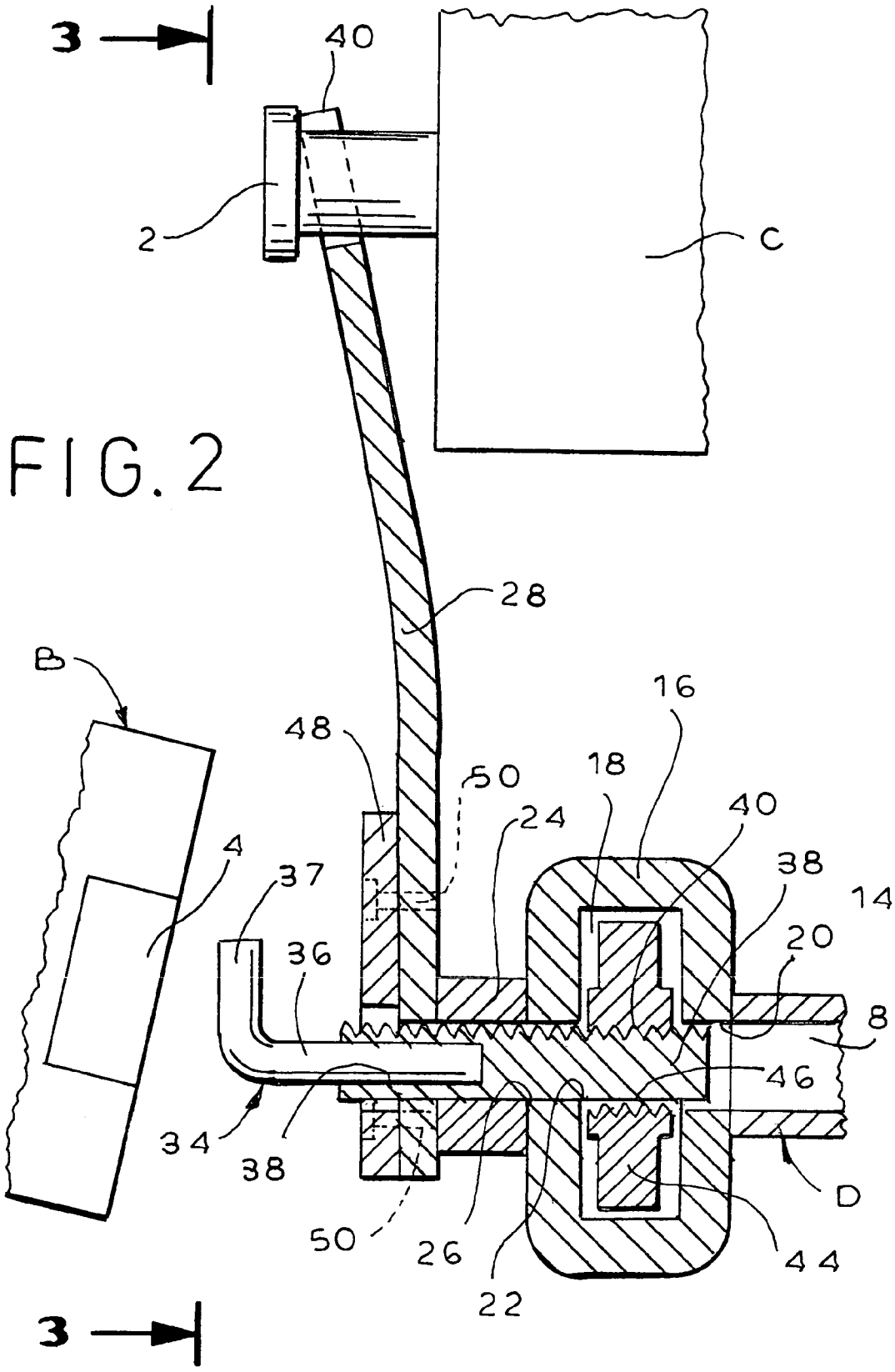
FIG. 2 is a cross sectional view, on an enlarged scale, of the vehicle engaging portions of the lever of the present invention, showing the operative portion of the lever engaged with the door jamb but, for purposes of illustration, disengaged from the door.

The preferred manner in which this tool is used is as follows: the door B is opened somewhat, and the laterally extended portion 37 of the rod 36 is slid into the door latch 4, where it is engaged and locked by the latch. The wheel 44 is then rotated to cause the shaft 38 to move into the lever to the right, as seen in FIG. 2, thus drawing the lever up to the door edge 6 and causing the protective plate 48 to move bodily into engagement with the door edge 6, thus clamping the lever into position on the door. The door is then moved to cause the arm 28 to engage with the pin 2, as disclosed. It is not mandatory to engage the tool into the door latch 4 first, but following the preferred sequence disclosed provides improved access to the wheel 44 and reduces the chance of damage to the door and the door jamb. To remove the tool after it has served its purpose, the procedure is reversed. The door is opened, disengaging the arm 28 from the pin 2, the wheel 44 is reversely rotated, moving the protective plate 48 away from the door edge 6, the door latch is opened and the tool is removed.

It is significant that the wheel 44 is located at a point relatively remote from the door B and the door jamb C and hence is readily accessible for manipulation from either the top or the bottom of the tool. It is further significant that the protective plate 48 is pressed up against the door edge 6 without rotation, thus substantially eliminating friction between it and the door, so that wear on the surface of the protective plate 48 is greatly minimized, and damage to the door edge 6 and elements mounted thereon is likewise eliminated.

Figure 3:
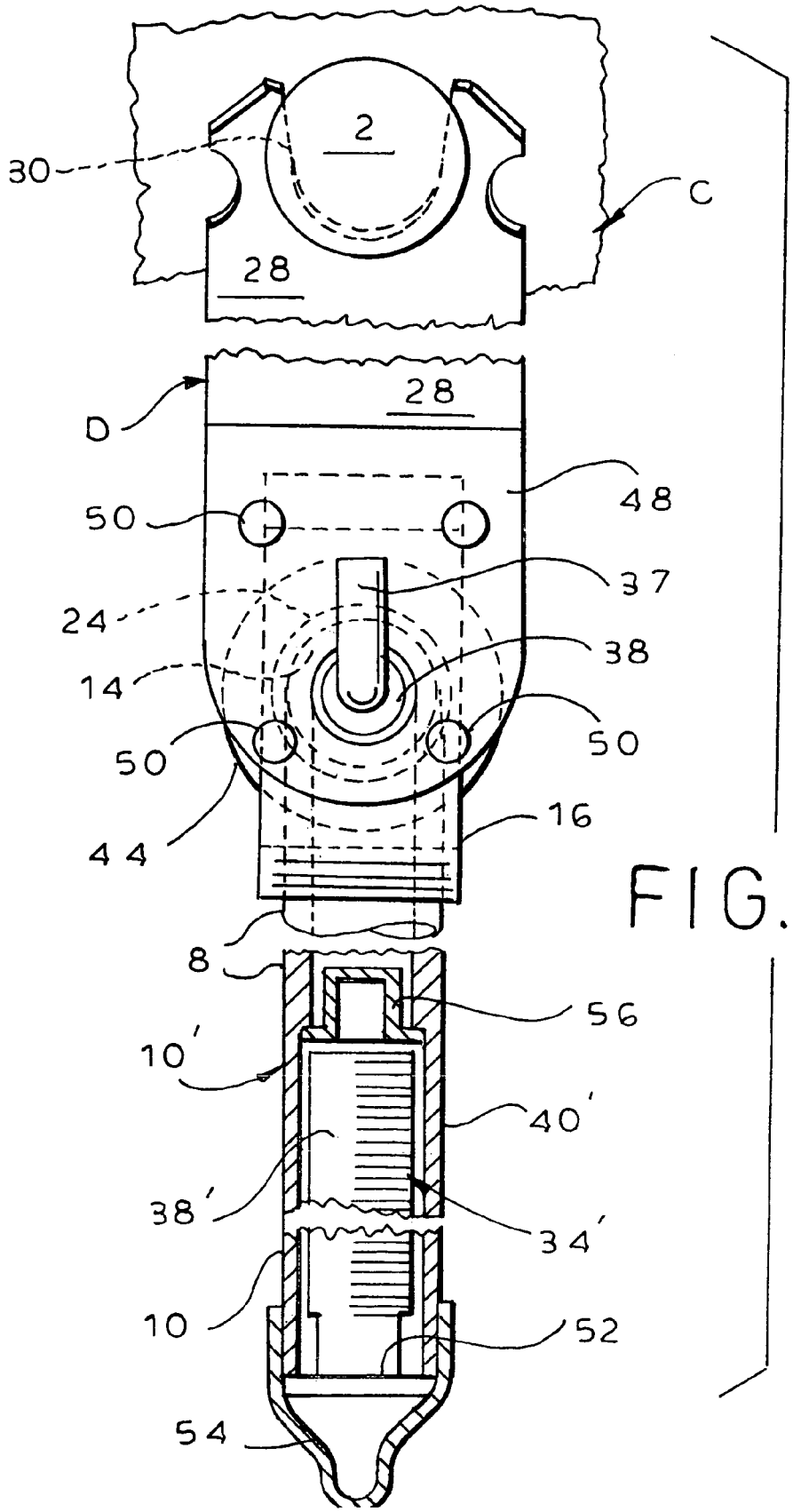
FIG. 3 is a fragmentary top plan view of the lever of the present invention taken along the line 3—3 of FIG. 2, including a cross-sectional view of the remote end of the lever.
Figure 4:
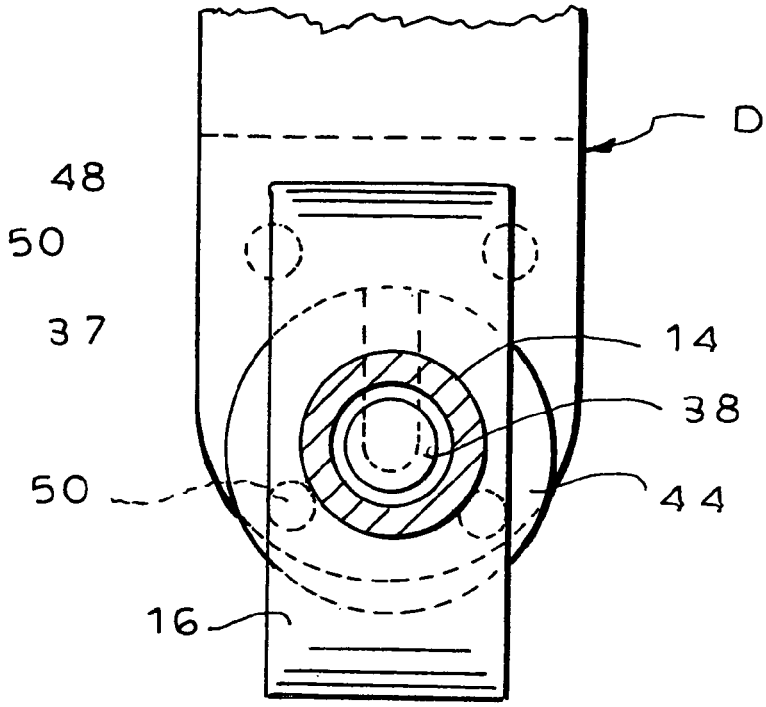
FIG. 4. is a fragmentary view of the lever taken along the line 4—4 of FIG. 1.

Not all vehicles have door latches adapted to cooperate with a part 34 of the type shown in FIG. 2 ending in the L-shaped rod 36, 37. Some are adapted to cooperate with pins having shoulder bolt type heads. For such vehicles the part 34' useable with the lever of the present invention may take the form disclosed in FIG. 3, with a body 38' of non-circular cross-section and with external threading 48' over only a portion of its periphery, provided at its end with a shoulder bolt head 52. It is adapted to be inserted into the lever and threadedly engaged with the wheel 44 just as is disclosed above with respect to the part 34. Since a repairman may be called upon at different times to align the doors of vehicles having different types of latches, the lever may, for the convenience of the repairman, carry in addition to the part 34, a part 34' ready for use when required. As shown in the cross-section lever end 10 in FIG. 3, the alternatively useable part 34' may be stored in the open end of the tubular lever 8. The interior of the end of the tube 8 may be provided with a shoulder on which a plug 56 is adapted to rest and that plug is so located along the length of the tube 8 that the part 34' may be received therein, the open end of the tube 8 being closed by a pull-off end cap 54, which retains the part 34 in place until it is to be used.

It will be appreciated from the above that with the construction of the present invention the force required for door alignment may be readily applied by a sturdy and relatively inexpensive structure which can conveniently be brought into firm engagement with the door edge after it has been engaged with the door latch and then engaged with the door jamb, and just as conveniently disengaged, with the part of the lever firmly engaging the door edge being so constructed as to minimize damage to the door and wear on the lever, with manipulation of the lever to engage with and disengage from the door edge being readily accomplished at a location which is easily accessible to the repairman.

While but a single embodiment of the present invention has been here specifically disclosed, it will be apparent that many variations may be made therein without departing from the spirit of the invention as defined in the following claims.

I claim:

1. A vehicle door alignment device comprising an elongated lever one portion of which is adapted to be grasped and manipulated and another portion of which remote from said one portion carries first means adapted to engaging an element on a door jamb of the vehicle, and second means on said lever spaced from said first means and adapted to engage a door associated with said door jamb of said vehicle, said door engaging means comprising a part mounted on said lever and extending therefrom in a given direction for engagement with said door, said part being mounted on said lever for adjustable positioning in said given direction, exposed means on said lever operatively connected to said part for adjusting said positioning of said part, and a protector fixedly secured to said lever adjacent to said part and facing in the direction that said part extends from said lever.

2. The device of claim 1, in which said lever, where said part is mounted thereon, comprises a passage extending in said given direction in which said part is received for adjustable axial positioning and from which said part outwardly extends in said given direction, said passage opening inwardly into an open space on said lever and said part extending into said open space, and an element at least partially located in said open space, operatively engaging said part, at least partly accessibly exposed at said open space for manual manipulation and effective when manipulated to cause said part to extend from said lever to an adjustable distance.

3. The device of claim 2, in which said part is non-rotatably received in said passage.

4. The device of claim 3, in which said part and said passage have cooperating non-circular cross sections.

5. The device of any of claims 2, 3 or 4, in which that portion of said part received in said open space is externally threaded over at least a portion of its periphery and in which said exposed element is threadedly engaged with said portion of said part.

6. The device of any of claims 1–4, in which said protector substantially surrounds said part where said part extends from said lever.

7. A vehicle door aligning device comprising a lever having a first section extending an appreciable distance from an end attached to be grasped and manipulated and connected to an angled section from which a third section extends, and means on said third section for engaging with a door jamb of a vehicle, said angled section forming, adjacent where it meets said third section, a space open to and accessible from the exterior of said lever, said angled section having a passage extending inwardly from the exterior of said lever to said open space, a part adapted to engage a door associated with said door jamb, said part being axially moveably received in said passage, extending from said lever, and having a portion thereof extending into said open space, a moveable element in said open space, externally engaged with said portion of said part, and effective when moved to cause said part to extend out from said lever to an adjustable degree.

8. In the device of claim 7, a protector fixedly secured to the exterior of said lever adjacent to said part extending therefrom.

9. In the device of claim 7, a protector fixedly secured to the exterior of said lever adjacent to said part extending therefrom and surrounding said part.

10. The device of any of claims 7–9, in which said part is non-rotatably received in said passage.

11. The device of claim 7, in which the portion of such part extending into said open space is externally threaded and said element is rotatably threadedly engaged with said part.

* * * * *